US006158419A

United States Patent [19]

Jett et al.

[11] Patent Number: 6,158,419

[45] Date of Patent: Dec. 12, 2000

[54] CONTROL VALVE ASSEMBLY FOR PUMPS AND INJECTORS

[75] Inventors: Bryan Thomas Jett, Lowell; Gregg R. Spoolstra, Byron Center, both of Mich.

[73] Assignee: Diesel Technology Company, Kentwood, Mich.

[21] Appl. No.: 09/265,683

[22] Filed: Mar. 10, 1999

[51] Int. Cl.[7] ..... F02M 37/04

[52] U.S. Cl. ..... 123/446; 123/496

[58] Field of Search ..... 123/446, 496, 123/495, 497

[56] References Cited

U.S. PATENT DOCUMENTS

| | | |
|---|---|---|
| 2,019,650 | 11/1935 | Bischof . |
| 2,022,643 | 11/1935 | Hueber et al. . |
| 2,190,464 | 2/1940 | Wile . |
| 2,770,394 | 11/1956 | Muller . |
| 3,556,464 | 1/1971 | Griswold . |
| 3,779,225 | 12/1973 | Watson et al. . |
| 3,810,485 | 5/1974 | Gawlick et al. . |
| 3,958,902 | 5/1976 | Toyoda et al. . |
| 4,161,161 | 7/1979 | Bastenhof . |
| 4,174,693 | 11/1979 | Steinwart et al. . |
| 4,214,565 | 7/1980 | Knapp et al. . |
| 4,269,361 | 5/1981 | Seilly . |
| 4,303,096 | 12/1981 | Skinner . |
| 4,417,693 | 11/1983 | Füssner et al. . |
| 4,445,484 | 5/1984 | Marion . |
| 4,485,843 | 12/1984 | Wolff . |
| 4,501,246 | 2/1985 | LeBlanc . |
| 4,569,641 | 2/1986 | Falk et al. . |
| 4,618,095 | 10/1986 | Spoolstra . |
| 4,619,239 | 10/1986 | Wallenfang et al. . |
| 4,627,571 | 12/1986 | Kato et al. . |
| 4,628,727 | 12/1986 | Seaman et al. . |
| 4,730,585 | 3/1988 | Abe et al. . |
| 4,747,545 | 5/1988 | Trachte et al. . |
| 4,782,807 | 11/1988 | Takahashi . |
| 4,829,967 | 5/1989 | Nati . |
| 4,889,288 | 12/1989 | Gaskell . |
| 4,911,366 | 3/1990 | Priesner . |
| 4,917,065 | 4/1990 | Law et al. . |
| 4,957,275 | 9/1990 | Homes . |
| 4,979,674 | 12/1990 | Taira et al. . |
| 4,986,728 | 1/1991 | Fuchs . |
| 5,025,768 | 6/1991 | Eckert . |
| 5,062,449 | 11/1991 | Woollums et al. . |
| 5,118,076 | 6/1992 | Homes . |
| 5,125,807 | 6/1992 | Kohler et al. . |
| 5,241,935 | 9/1993 | Beck et al. . |
| 5,341,783 | 8/1994 | Beck et al. . |
| 5,345,916 | 9/1994 | Amann et al. . |
| 5,373,828 | 12/1994 | Askaw . |
| 5,385,455 | 1/1995 | Dinsmore et al. . |
| 5,423,484 | 6/1995 | Zuo . |
| 5,425,341 | 6/1995 | Connolly et al. . |
| 5,427,352 | 6/1995 | Brehm . |

(List continued on next page.)

FOREIGN PATENT DOCUMENTS

| | | |
|---|---|---|
| 0803 648 A1 | 10/1997 | European Pat. Off. . |
| WO 97/01031 | 1/1997 | WIPO . |

OTHER PUBLICATIONS

U.S. application No. 08/911,819, Straub et al., filed Aug. 15, 1997.

U.S. application No. 09/133,350, Spoolstra, filed Aug. 13, 1998.

U.S. application No. 09/209,725, Spoolstra.

*Primary Examiner*—Thomas N. Moulis
*Attorney, Agent, or Firm*—Brooks & Kushman, P.C.

[57] ABSTRACT

Pumps and injectors utilize a control valve having a valve body with a valve stem having a step adjacent to the seating surface. The step extends a limited distance away from the seating surface to provide limited pressure relief when the valve body is at an intermediate position that is between the opened and closed positions. Step cross-section and axial length may be configured based on desired hydraulic behavior. In a preferred embodiment, the control valve step is configured for injection rate shaping.

24 Claims, 7 Drawing Sheets

U.S. PATENT DOCUMENTS 5,464,334 11/1995 Cook et al. .
5,494,219 2/1996 Maley et al. .
5,517,972 5/1996 Stockner .
5,524,826 6/1996 Mueller et al. .
5,533,481 7/1996 Kronberger .
5,562,428 10/1996 Bailey et al. .
5,566,660 10/1996 Camplin et al. .
5,619,969 4/1997 Liu et al. .
5,632,444 5/1997 Camplin et al. .
5,647,536 7/1997 Yen et al. .
5,651,345 7/1997 Miller et al. ..... 123/496
5,651,501 7/1997 Maley et al. .
5,662,087 9/1997 McCandless .
5,669,356 9/1997 Wall et al. .
5,673,853 10/1997 Crofts et al. .
5,685,490 11/1997 Ausman et al. .
5,694,903 12/1997 Ganser .
5,706,778 1/1998 Kapus .
5,709,341 1/1998 Graves .
5,711,277 1/1998 Fuseya .
5,727,738 3/1998 Hofmann et al. .
5,730,104 3/1998 Hafner .
5,730,261 3/1998 Spakowski et al. .
5,738,075 4/1998 Chen et al. .
5,749,717 5/1998 Straub et al. .
5,752,659 5/1998 Moncelle .
5,765,755 6/1998 Peters et al. .
5,769,319 6/1998 Yen et al. .
5,803,370 9/1998 Heinz et al. .
5,860,597 1/1999 Tarr .
5,868,317 2/1999 English .
5,967,413 10/1999 Tian .
6,019,091 2/2000 Spoolstra ..... 123/496

CONTROL VALVE ASSEMBLY FOR PUMPS AND INJECTORS

TECHNICAL FIELD

This invention relates to a control valve for use in a pump or injector of a fuel injection system.

BACKGROUND ART

Engine exhaust emission regulations are becoming increasingly restrictive. One way to meet emission standards is to rate shape the quantity and timing of the fuel injected into the combustion chamber to match the engine cycle. Effective rate shaping may result in reduced levels of particulate and oxides of nitrogen in the engine exhaust. Further, effective rate shaping that injects fuel slower during the early phase of the combustion process results in less engine noise.

Existing rate shaping techniques attempt to control injection rates by making various modifications to the injector nozzle assembly. The nozzle assembly rate shaping technologies create undesirable effects such as poor spray patterns resulting in less than optimal fuel economy and particulates. Although these existing rate shaping techniques have been employed in some applications, there is a need for a rate shaping technique that allows more precise rate shaping than the existing modified injector nozzle assemblies.

DISCLOSURE OF INVENTION

It is, therefore, an object of the present invention to provide pumps and injectors having a control valve capable of shaping the injection rate.

In carrying out the above object, a pump for a fuel injection system is provided. The pump comprises a pump body having a pumping chamber, a fuel inlet for supplying fuel to the pumping chamber, an outlet port, and a valve chamber between the pumping chamber and the outlet port. The valve chamber defines a valve seat and has an axial guiding portion with a central axis. A plunger is disposed in the pumping chamber. A valve body disposed in the valve chamber controls fuel. The valve body has a valve stem defining a seating surface. The valve body further has a valve guide that is received in the valve chamber guiding portion. The valve body is axially movable with respect to the guiding portion over a stroke range between a closed position and an open position. In the closed position, the valve body seating surface engages the valve seat of the valve chamber. In the open position, the valve body seating surface is spaced from the valve seat to provide pressure relief. The valve stem has a step adjacent to the seating surface. The step extends a limited distance away from the seating surface to provide limited pressure relief when the valve body is at an intermediate position that is between the open and closed positions.

The pump further comprises a valve spring arrangement, an armature, and a stator. The valve spring arrangement biases the valve body toward the open position. The stator includes an actuator that is operative to urge the valve body toward the closed position against the bias of the valve spring.

In a preferred embodiment, the valve body has a generally circular cross-section, and the step diameter is less than the valve guide diameter. Preferably, the step has a cross-section that is sized based on a desired intermediate pressure. Further, preferably, the step has an axial length that is sized based on a desired hydraulic performance at the end of an injection event. In a preferred embodiment, the step is configured primarily for injection rate shaping at the beginning of an injection event. The step preferably has a cross-section that is sized based on a desired rate shaping pressure.

In a preferred embodiment, the stroke range is at least about 0.1 millimeters. Further, a distance between the closed position and the intermediate position is preferably at most about 0.03 millimeters. Further, the step preferably has an axial length that is about two times a distance between the closed position and the intermediate position. Preferably, the step axial length is about 0.05 millimeters. Further, preferably, the valve body has a generally circular cross-section, with the valve guide having a guide diameter of about 7.00 millimeters, and the step having a step diameter of about 6.99 millimeters.

In a preferred construction, the valve spring arrangement comprises a primary spring biasing the valve body toward the open position over substantially the entire stroke range, and a secondary spring biasing the valve body toward the closed position over a limited portion of the stroke range between the intermediate position and the open position.

Further, in carrying out the present invention, a fuel injector is provided. The fuel injector comprises an injector body having a pumping chamber with a plunger disposed therein, and a valve chamber with a valve body disposed therein. The valve body includes a valve stem with a step adjacent to the seating surface. The step extends a limited distance away from the seating surface to provide limited pressure relief when the valve body is at an intermediate position that is between the open and closed positions.

Still further, in carrying out the present invention, a control valve for use in a fuel injection system is provided. A control valve comprises a housing defining a valve chamber. The valve chamber defines a valve seat and further defines an axial guiding portion with a central axis. The control valve further comprises a valve body disposed in the valve chamber. The valve body includes a valve stem having a step adjacent to the seating surface. The step extends a limited distance away from the seating surface to provide limited pressure relief when the valve body is at an intermediate position that is between the open and closed positions.

Yet further, in carrying out the present invention, an engine is provided. The engine comprises an engine block having at least one cylinder, at least one fuel injector positioned to feed fuel to the at least one cylinder, and a control valve. The fuel injector is in communication with a fuel supply. The control valve is located between the at least one cylinder and the fuel supply. The control valve includes a valve stem having a step adjacent to the seating surface. The step extends a limited distance away from the seating surface to provide limited pressure relief when the valve body is at an intermediate position that is between the open and closed positions.

The advantages associated with embodiments of the present invention are numerous. For example, control valves made in accordance with the present invention for pumps or injectors allow effective rate shaping by controlling the pressure supplied to the pump outlet or injector nozzle assembly of a unit injector. Rate shaping at the control valve advantageously allows more precise rate shaping than some existing rate shaping techniques that attempt to rate shape with a modified injector nozzle assembly. Injection pressure control is used instead of throttling at the nozzle for injection rate shaping. Further, the step facilitates the achievement of a limited and controlled pressure relief. That is, the step provides a small amount of tolerance for the intermediate position, which may be a rate shaping position. Further, when combined with multiple springs and current control, the stepped control valve may greatly improve the ability to throttle at the control valve.

It is to be appreciated that the throttle step cross-section and axial length may be varied to produce whatever hydraulic behavior is desired at different portions of the injection event. Of course, control valves of the present invention are particularly useful for beginning of injection rate shaping; however, other uses may be contemplated.

The above object and other objects, features, and advantages of the present invention will be readily appreciated by one of ordinary skill in the art from the following detailed description of the best mode for carrying out the invention when taken in connection with the accompany drawings.

BEST MODE FOR CARRYING OUT THE INVENTION

Figure 1:
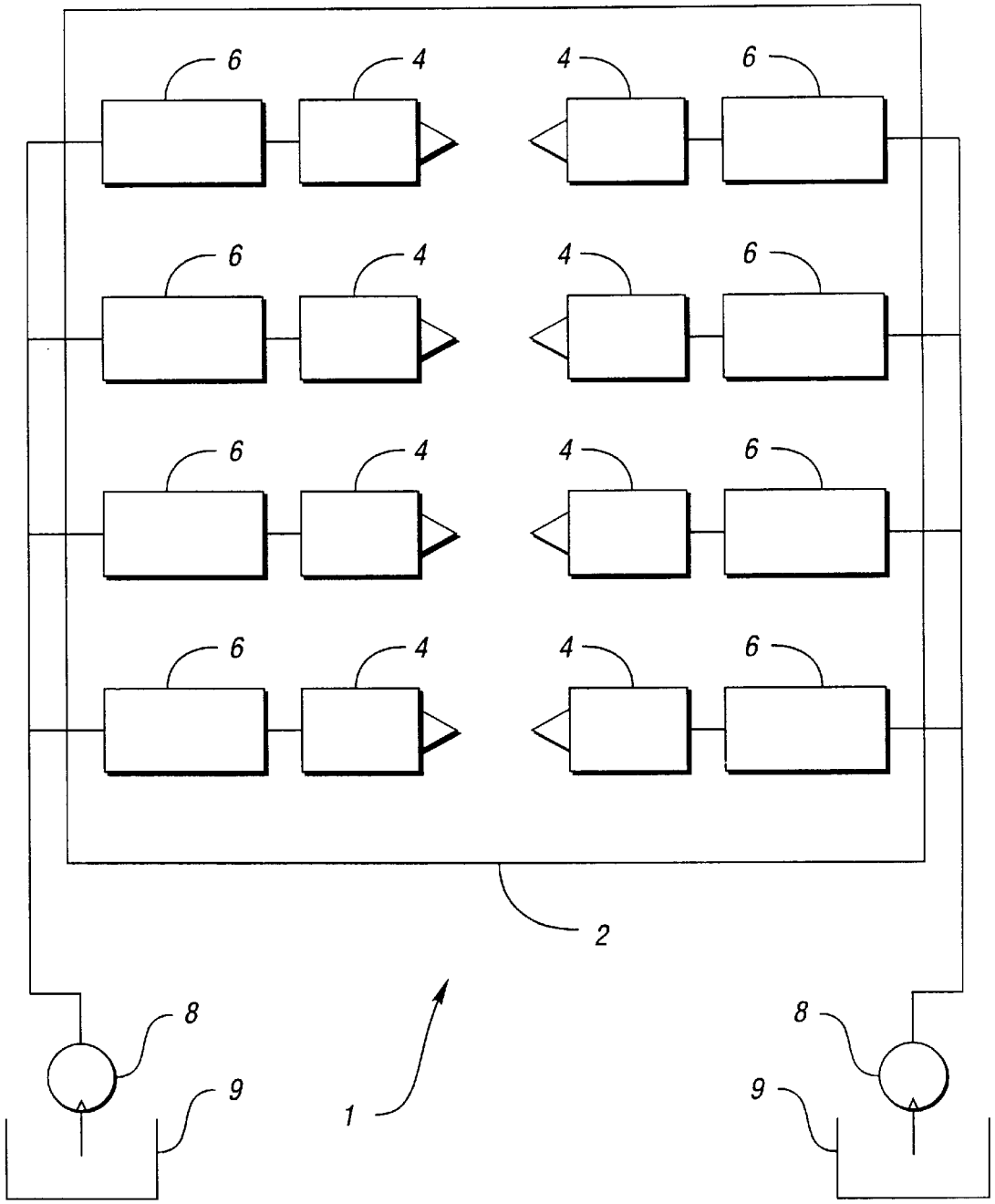
FIG. 1 is an engine made in accordance with the present invention.

Referring to FIG. 1, an engine made in accordance with the present invention is generally indicated at 1. An engine block 2 has a plurality of cylinders. Fuel injectors 4 are positioned to feed fuel to the cylinders. Fuel injectors 4 may be unit injectors having a pumping device incorporated therein, or may be in communication with one or more high pressure pumps 6. As shown, each injector 4 is in communication with a high pressure pump 6, and a throttling control valve of the present invention would accordingly be located within each pump 6. Fuel is supplied to engine block 2 by one or more low pressure pumps 8 in communication with one or more fuel supplies 9.

Figure 2:
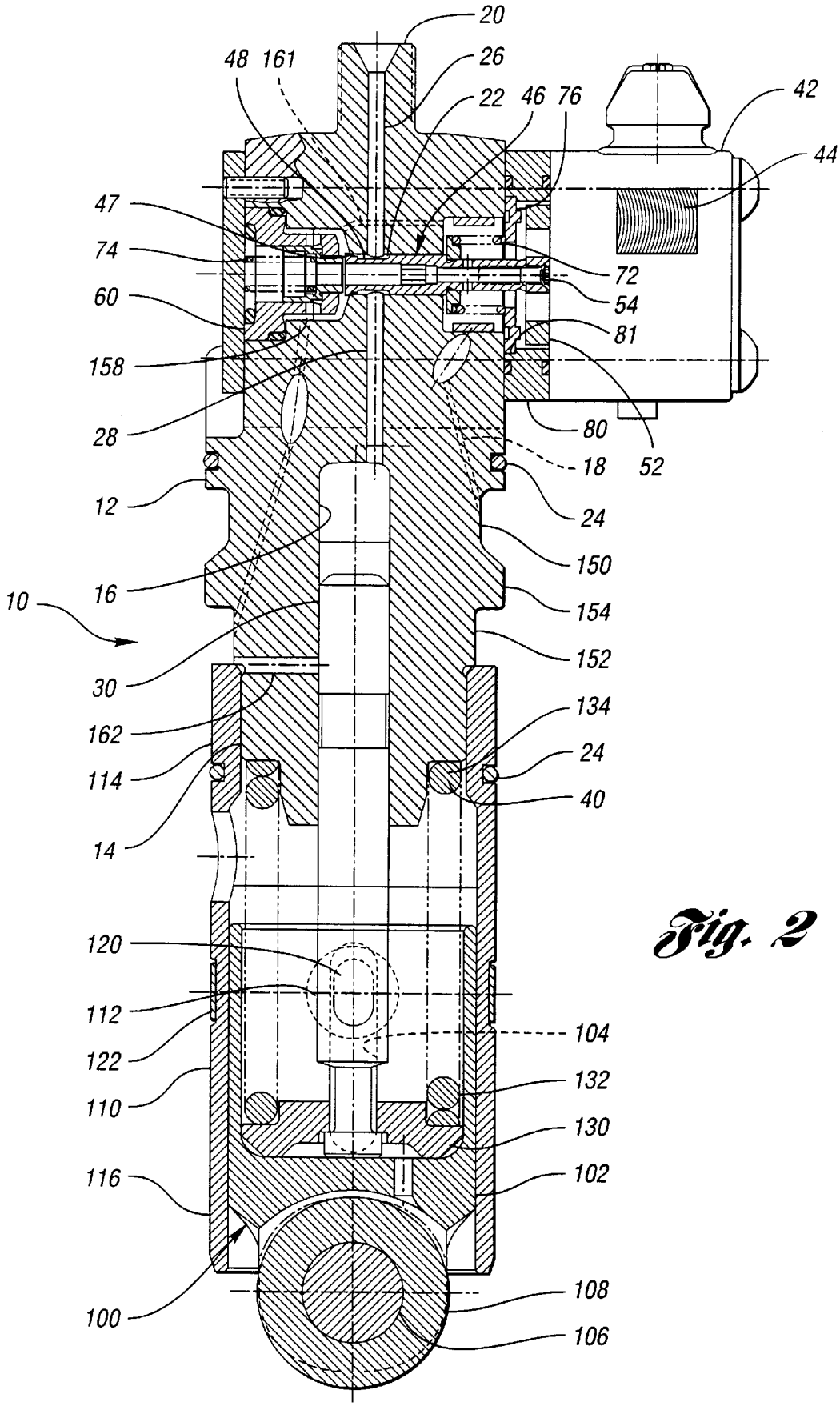
FIG. 2 is a side elevation, in section, of a pump for a fuel injection system made in accordance with the present invention.
Figure 3:
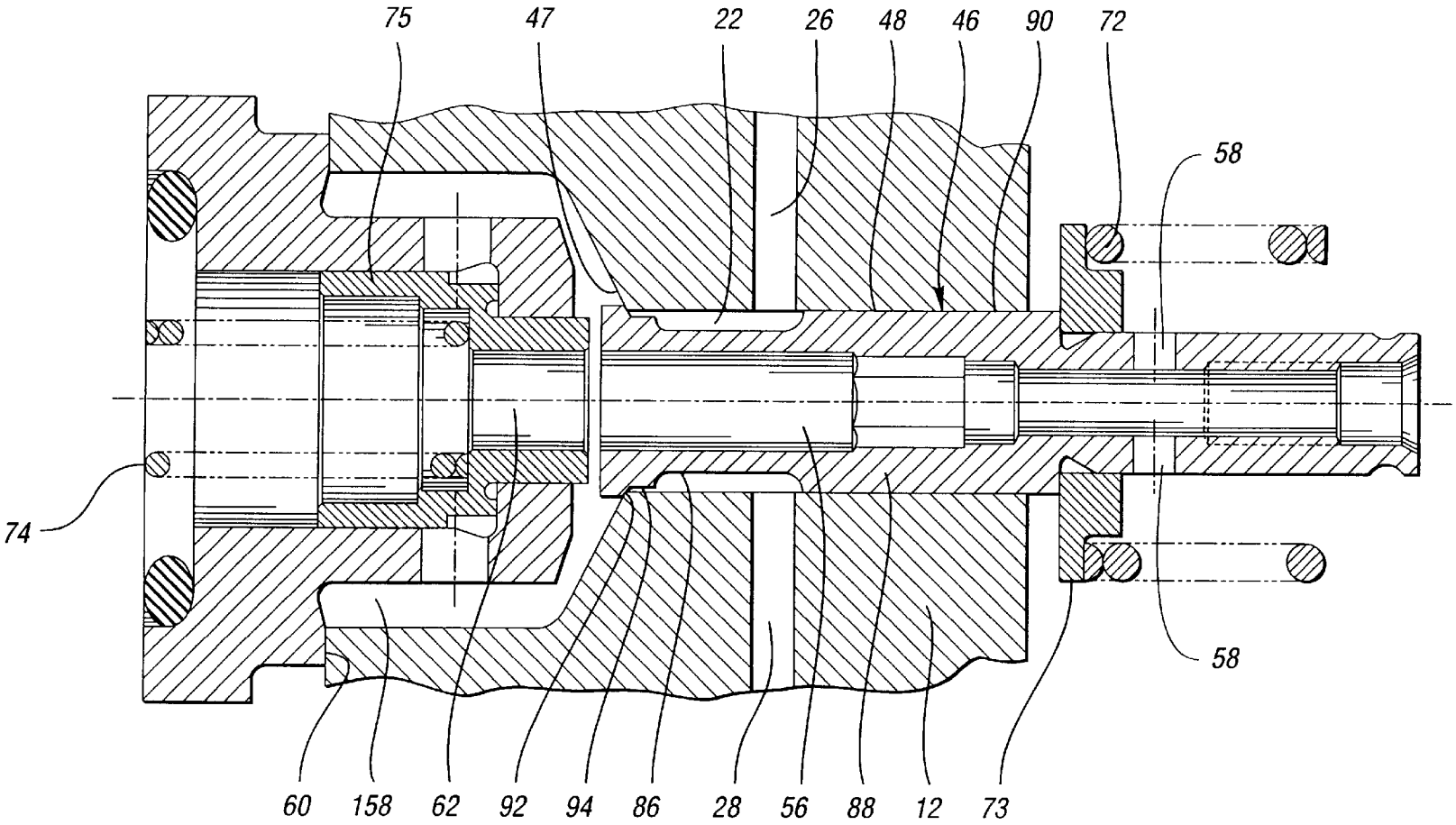
FIG. 3 is an enlarged cross-sectional view of the control valve environment on the pump shown in FIG. 1.

Referring to FIGS. 2 and 3, and primarily to FIG. 2, a pump 10 made in accordance with the present invention is illustrated. Pump 10 has a pump body 12 with a pump body end portion 14. A pumping chamber 16 is defined by pump body 12. A fuel inlet 18 supplies fuel to pumping chamber 16 (through passage 161, stop cavity 158, past control valve seat 47, control valve annulus 22 and passageway 28). Pump body 12 further has an outlet port 20, and a control valve chamber 22 between pumping chamber 16 and outlet port 20. O-rings 24 are provided to seal fuel inlet 18 with respect to an engine block which receives pump 10. Passageways 26 and 28 connect outlet port 20, control valve chamber 22, and pumping chamber 16.

A reciprocating plunger 30 is disposed in pumping chamber 16. Plunger 30 is reciprocatable over a stroke range between an extended position indicated at 30 and a compressed position (not specifically shown). A plunger spring 40 resiliently biases plunger 30 to the extended position.

A stator assembly 42 includes an electromagnetic actuator such as a solenoid 44, and has terminals for connecting to a power source to provide power for electromagnetic actuator 44. An electromagnetically actuated control valve 46 is disposed in control valve chamber 22 for controlling fuel. Control valve 46 includes a valve body 48. Valve body 48 is movable over stroke range between an open position and a closed position as will be further described. The closed position is the actuated position for valve body 48 where the valve is pulled to the valve seat 47, and the open position is the deactuated position for valve body 48.

An armature 52 is secured to valve body 48 by a fastener such as a screw 54. A valve stop 60 is disposed in pump body 12 adjacent to control valve chamber 22. A control valve spring arrangement resiliently biases valve body 48 toward the deactuated position, which is the open position, as will be further described below. A stator spacer 80 has a central opening receiving armature 52 therein, and is disposed between pump body 12 and stator assembly 42. Stator spacer 80 has notches 81 for receiving retainer 76. O-rings seal stator spacer 80 against stator assembly 42 and pump body 12. Electromagnetic actuator 44 is near armature 52, and upon actuation, urges valve body 48 toward the closed position against the bias of the control valve spring arrangement when current is applied to the stator, producing a magnetic field that attracts the armature to the stator.

With continuing reference to FIGS. 2 and 3, a cam follower assembly 100 is illustrated. Cam follower assembly 100 has a housing 102 with an elongated slot 104. Cam follower assembly 100 has an axle 106 and a roller 108 for engagement with a camshaft (not shown). Plunger 30 is reciprocated within pumping chamber 16 between the extended and compressed positions by cam follower assembly 100. A cylindrical sleeve 110 has an aperture 112 in communication with elongated slot 104. Cylindrical sleeve 110 has first and second end portions 114 and 116, respectively. Pump body end portion 14 interfits with first end portion 114 of cylindrical sleeve 110.

Second end portion 116 of cylindrical sleeve 110 relatively reciprocatably interfits with cam follower assembly 100 for allowing cam follower assembly 100 to drive plunger 30. Cam follower assembly 100 reciprocates within cylindrical sleeve 110 and drives plunger 30 relative to cylindrical sleeve 110 over the plunger stroke range. Preferably, a retainer guide 120 extends through aperture 112 and engages slot 104 in cam follower assembly 100. A clip 122 retains guide 120 within aperture 112.

A plunger spring seat 130 is received in housing 102 of cam follower assembly 100. Plunger spring seat 130 abuts a first end 132 of plunger spring 40. Pump body end portion 14 abuts a second end 134 of plunger spring 40.

Pump body 12 has a first annulus 150 in communication with fuel inlet 18 for supplying fuel to the pumping chamber 16. Pump body 12 further has a second annulus 152 in communication with pumping chamber 16 for receiving excess fuel therefrom. An annular belt 154 separates first and second annuli 150 and 152, respectively. Of course, alternative embodiments may employ an inlet/outlet passageway instead of separate inlet 18 and outlet 160, as is appreciated by one of ordinary skill in the art of fuel injection system control valves.

An excess fuel chamber 158 also called the stop cavity, receives excess fuel from control valve chamber 22 when the valve body 48 is open past control valve seat 47. A fuel pressure equalizing passage 161 provides fuel communication between excess fuel chamber 158 and the control valve and spring chambers such that control valve 46 is operable as a pressure balanced valve. Preferably, valve body 48 has passage 56 and 58 (FIG. 3) to provide additional fuel communication and to also provide cooling. A return passageway 160 connects excess fuel chamber 158 to second annulus 152. Another return passageway 162 connects pumping chamber 16 to second annulus 152 for receiving any fuel that leaks between plunger 30 and pump body 12. Second annulus 152 is defined by annular belt 154 and first end portion 114 of cylindrical sleeve 110. As well known in the art, fuel is supplied to pump 10 through internal fuel passageways in the engine block (not shown).

With reference to FIGS. 3 through 6, and as best shown in FIG. 3, valve stop 60 is adjacent to control valve chamber 22. Valve body 48 has a valve stem 86 that defines a seating surface 92. Further, valve body 48 has a valve guide 88 received in guiding portion 90 of the valve chamber. Valve body 48 is axially moveable over a stroke range between closed position and an open position, with an intermediate position located therebetween. In a preferred embodiment of the present invention, the control valve spring arrangement includes a primary spring 72 and a secondary spring 74. Primary spring 72 abuts seat 73 to bias valve body 48 of control valve 46 toward the open position over substantially the entire stroke range. Secondary spring 74 abuts stop piston 75 to bias valve body 48 toward the closed position over a limited portion of the stroke range between the intermediate position and the open position. Preferably, the intermediate position is a rate shaping position. Preferably, stop piston 75 has an axial passage 62 to further assist in damping valve opening.

Figure 4:
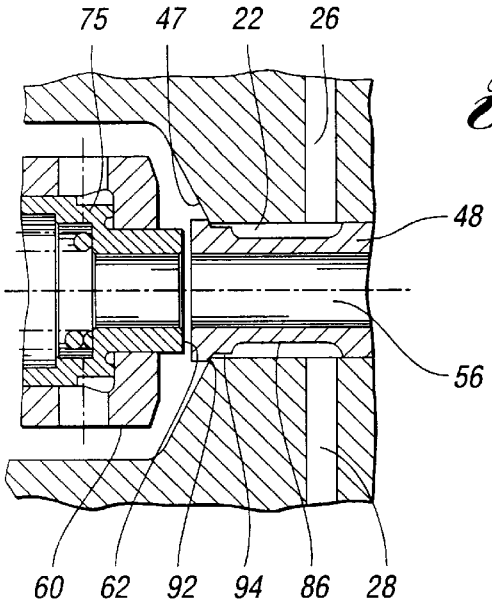
FIG. 4 is an enlarged cross-sectional view of a control valve of the present invention, showing the valve body in the fully closed position.

As best shown in FIG. 4, valve body 48 is in the fully closed position with valve seating portion 92 abutting control valve seat 47. As such, when the pump plunger causes pressure to build in control valve chamber 22, passageway 26, and passageway 28, the pressure bypass to stop cavity 158 (best shown in FIG. 3) is precluded.

Figure 5:
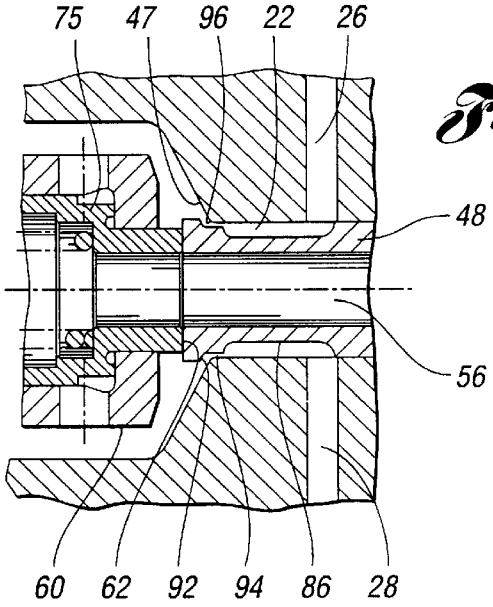
FIG. 5 is an enlarged cross-sectional view of a control valve of the present invention, showing the valve body in an intermediate position such as a rate shaping position.

As best shown in FIG. 5, valve body 48 is in the intermediate position. In a preferred embodiment of the present invention, the intermediate position is a rate shape position that, with the assistance of a step 94 adjacent to seating surface 92, provides limited pressure relief at the beginning of injection. Step 94 extends a limited distance away from seating surface 92 such that a partial opening of the control valve provides limited pressure relief, while a full opening allows significantly greater pressure relief to prevent pumping. Of course, one of ordinary skill in the art appreciates that step 94 may be employed to produce other hydraulic behavior, as desired, when appropriate cross-section and length are used for step 94. As such, when plunger 30 causes pressure to build in control valve chamber 22 and passageways 26 and 28, limited pressure relief or throttling takes place through gap 96 between step 94 and control valve seat 47.

In a preferred embodiment, valve body 48 has a generally circular cross-section. Of course, circular cross-section is preferred to facilitate manufacturing under the extremely small tolerances present in control valves for fuel injection systems. Further, it is preferred that the valve guide 88 of valve body 48 which is received in valve body guiding portion 90 has a larger diameter than step 94. Of course, this relationship is preferred so that control valve chamber 22 may have a constant diameter from one end to the other. In the event that control valve chamber 22 has a stepped diameter, other relationships may exist between guide diameter and step diameter. More particularly, the step cross-section (which is preferably circular) preferably is sized based on a desired intermediate pressure. In the exemplary embodiment wherein the step is used to facilitate controlled pressure relief for throttling during rate shaping, the step is sized (relative to the diameter of control valve seat 47) based on a desired pressure behavior during rate shaping.

In a rate shaping embodiment, it is preferred that a distance between the closed position (FIG. 4) and the intermediate rate shaping position (FIG. 5) is at most about 0.03 millimeters. Of course, other values may be suitable depending on the particular application for the pump or injector. More particular, step 94 has an axially length, in a preferred embodiment, that is about two times the distance between the closed position and the intermediate position. In the exemplary embodiment, that axial length is accordingly about 0.05 millimeters. This relationship is preferred so that the desired intermediate position is halfway along step 94 to maximize the ability to maintain desired hydraulic behavior with small variances of the actual intermediate position one way or the other either due to manufacturing tolerances, or due to wear and tear on control valve assembly components over normal use during the life of the pump or injector. In the preferred embodiment of the present invention illustrated herein that is designed for rate shaping, in which valve parts and the valve chamber have a generally circular cross-section, a suitable valve guide diameter is about 7.00 millimeters and a preferred step diameter is about 6.99 millimeters.

With continuing reference to FIGS. 3 to 6, and as best shown in FIG. 5, it is preferred that the spring stepping point for primary spring 72 and secondary spring 74 is the intermediate position. That is, valve body 48 contacts stop piston 75 causing a net reduction in the spring force acting on valve body 48 when valve body 48 reaches the intermediate position. In combination with current control, and spring force stepping, step 94 greatly enhances the ability for precise rate shaping or precise control of other hydraulic behavior as desired. Of course, it is to be appreciated that other configurations for stepping spring force may be employed, and that the particular embodiment shown herein with the primary spring located near the stator, and the secondary spring located within the valve stop is exemplary only. As such, multiple springs may be located at either side of control valve chamber 22. Further, additional stators may be employed on either side of control valve chamber 22. Still further, although it is preferred to use a pair of springs, if desired, secondary spring 74 may be eliminated, and current control alone may be relied upon to maintain valve body 48 at the intermediate position when desired. Thus, embodiments of the present invention employing a control valve step 94 are not dependent upon the spring configuration, or the stator configuration, and may be incorporated in any pump or injector having an electromagnetically actuated control valve regardless of the force sources for opening and closing the control valve.

Figure 6:
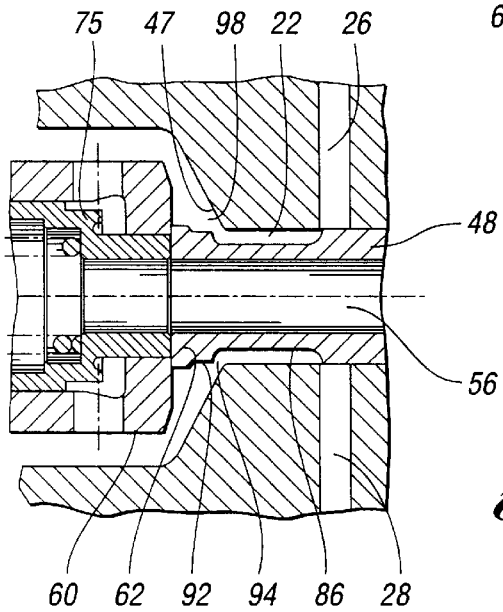
FIG. 6 is an enlarged cross-sectional view of a control valve of the present invention, showing the valve body in the fully open position.

As best shown in FIG. 6, valve body 48 is in the fully opened position. In the preferred embodiment, valve body 48 abuts stop piston 75 similar to when valve body 48 is in the intermediate position, however stop piston 75 is pushed further into valve stop 60 by valve body 48, slightly compressing secondary spring 74 such that seating surface 92 is significantly further away from seat 47 than when valve body 48 is in the intermediate position, providing significantly increased pressure relief through passage 98. Preferably, and as shown, step 94 is completely clear of valve seat 47 when valve body 48 is fully opened.

In a preferred embodiment of the present invention wherein control valve assembly 46 is configured for rate shaping, a suitable stroke range from full open to full closed is at least about 0.1 millimeters. Of course, other stroke ranges may be suitable depending on the particular application for the pump or injector.

Although step 94 may serve a variety of purposes for influencing desired hydraulic behavior, it is to be appreciated that embodiments of the present invention are particularly suitable for implementing rate shaping at a control valve in either a high pressure pump or in a unit injector. Further, although a quite thorough description of valve body positions and movement therebetween is given above, a more detailed discussion of control valve assemblies for rate shaping may be found in copending U.S. patent application serial number 09/209,725, filed on Dec. 11, 1998, entitled "Control Valve", and assigned to the assignee of the present invention, which is hereby incorporated by reference in its entirety. Further, additional control valve assemblies for rate shaping are described in U.S. copending patent application Ser. No. 09/133,350, filed on Aug. 13, 1998, entitled "Control Valve", and assigned to the assignee of the present invention, which is hereby incorporated by reference in its entirety. As such, it is to be appreciated that embodiments of the present invention control valve having a pressure relief or throttling step may be employed in pumps, injectors, and engines, described herein, or as described in either of the above referenced patent applications, or in any other manner that would be appreciated by one of ordinary skill in the art of fuel injection systems.

Figure 7:
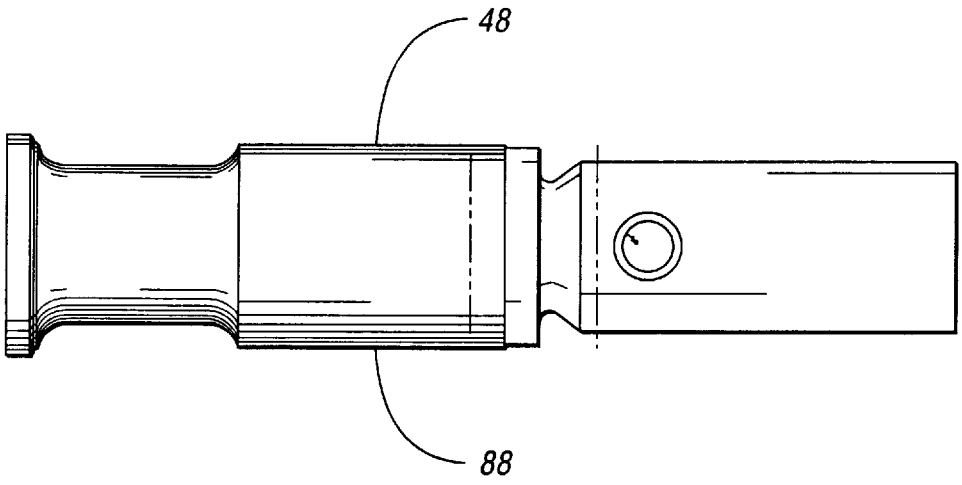
FIG. 7 is an enlarged plan view of a valve body for a control valve of the present invention.
Figure 8:
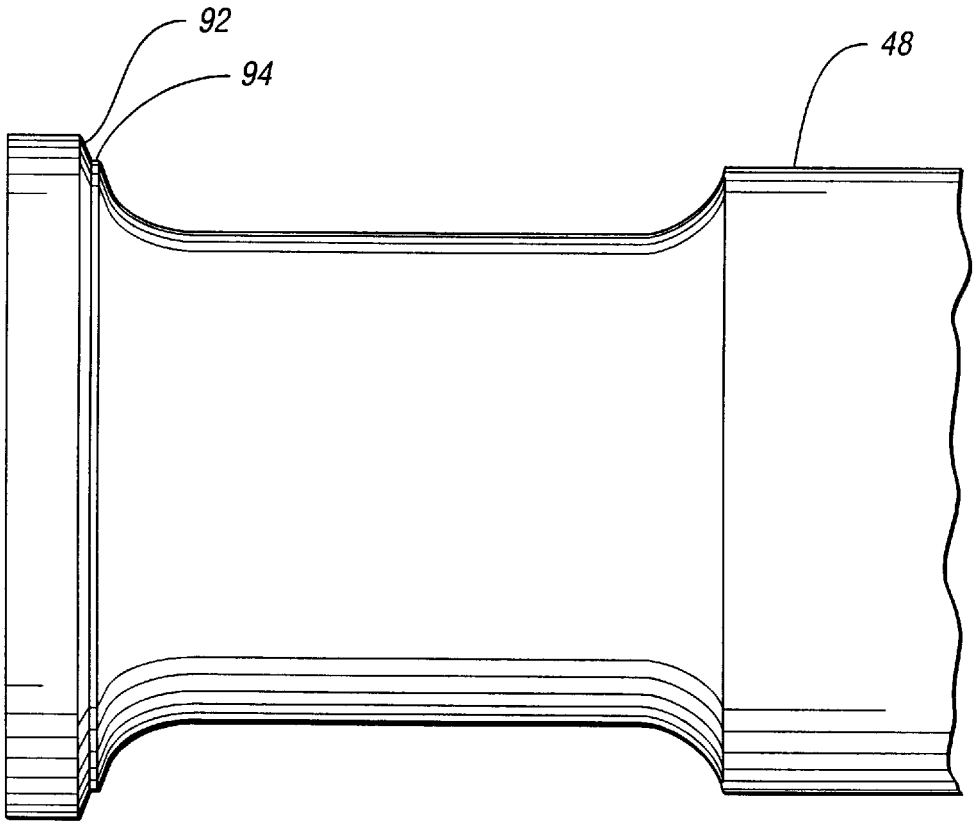
FIG. 8 is a further enlarged plan view of the valve stem on the valve body shown in FIG. 7.

With reference to FIGS. 7 and 8, enlarged views of valve body 48 are shown. As best shown in FIG. 8, step 94 is actually very small relative to the size of valve body 48. However, it is to be appreciated that exaggerated dimensions were used in FIGS. 3–6 to better illustrate form and function of step 94.

Figure 9:
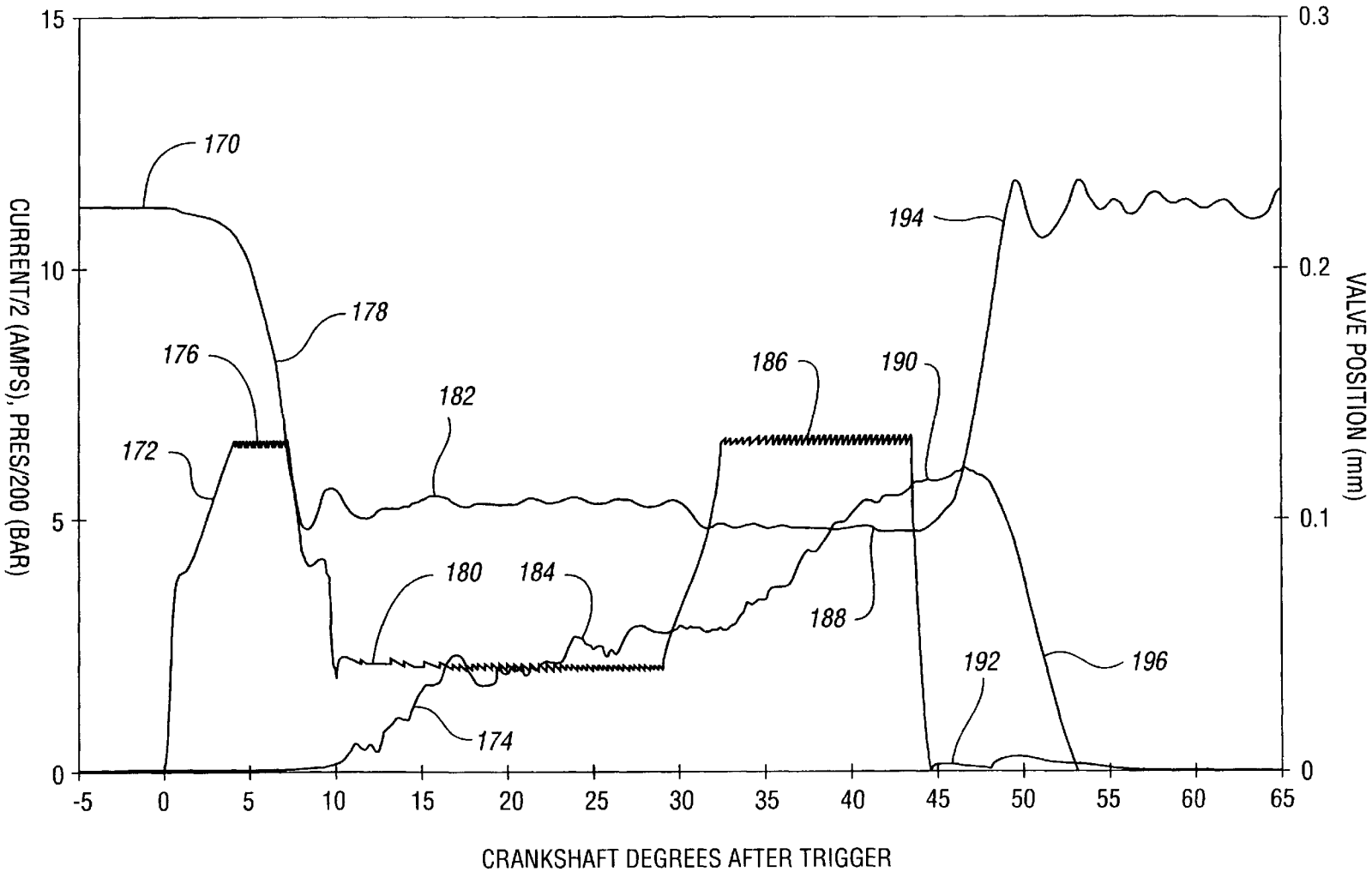
FIG. 9 is a graph depicting fuel injection characteristics in a single boot type injection with the control valve environment shown in FIG. 3.

With reference to FIG. 9, a graph depicting fuel injection characteristics in a single boot type injection with the control valve environment shown in FIG. 3 is illustrated. In the graph, plot 170 is valve position, plot 172 is solenoid current, and plot 174 is injection pressure, all with scales as indicated for the ordinate. Crank degrees after trigger is indicated along the abscissa. The particular injection event shown in FIG. 9 is a rate shaped, boot type, injection.

High current is applied at portion 176 of current plot 172. In response, the valve body begins to move toward the closed position as shown by portion 178 of valve position plot 170. Current plot portion 180 shows a lower current being applied to the solenoid. This lower current is sometimes referred to as current controlled rate shaping. In the preferred embodiment, this lowered current cooperates with the control valve spring arrangements such that the valve body moves to the intermediate position or rate shaping position as shown by valve position plot portion 182. Of course, as described previously, a variety of control valve assemblies may be employed including those with multiple stators, multiple springs, a single stator, a single spring, etc. Injection pressure plot portion 184 shows decreased or rate shaped pressure during the early part of the injection event.

High current is applied at current plot portion 186. In response, the valve body is pulled to the fully closed position as indicated by valve position plot portion 188. Injection pressure plot portion 190 shows the increased injection pressure toward the end of the injection event. Current plot portion 192 shows that the current is turned fully off near the end of injection. Valve position plot portion 194 shows the valve body returning to the fully open position. Pressure plot portion 196 shows the ramping down of injection pressure in response to full pressure relief at the control valve.

It is to be appreciated that the step 94 on the control valve smooths the slight pressure relief for throttling that occurs when the valve body is in valve position plot portion 182. That is, the slight wavering of valve position through valve position plot portion 182 has reduced effects on injection rate plot portion 184 because step 94 on valve body 48 reduces the effects of these slight variations in valve position, by providing a generally consistent pressure relief.

Figure 10:
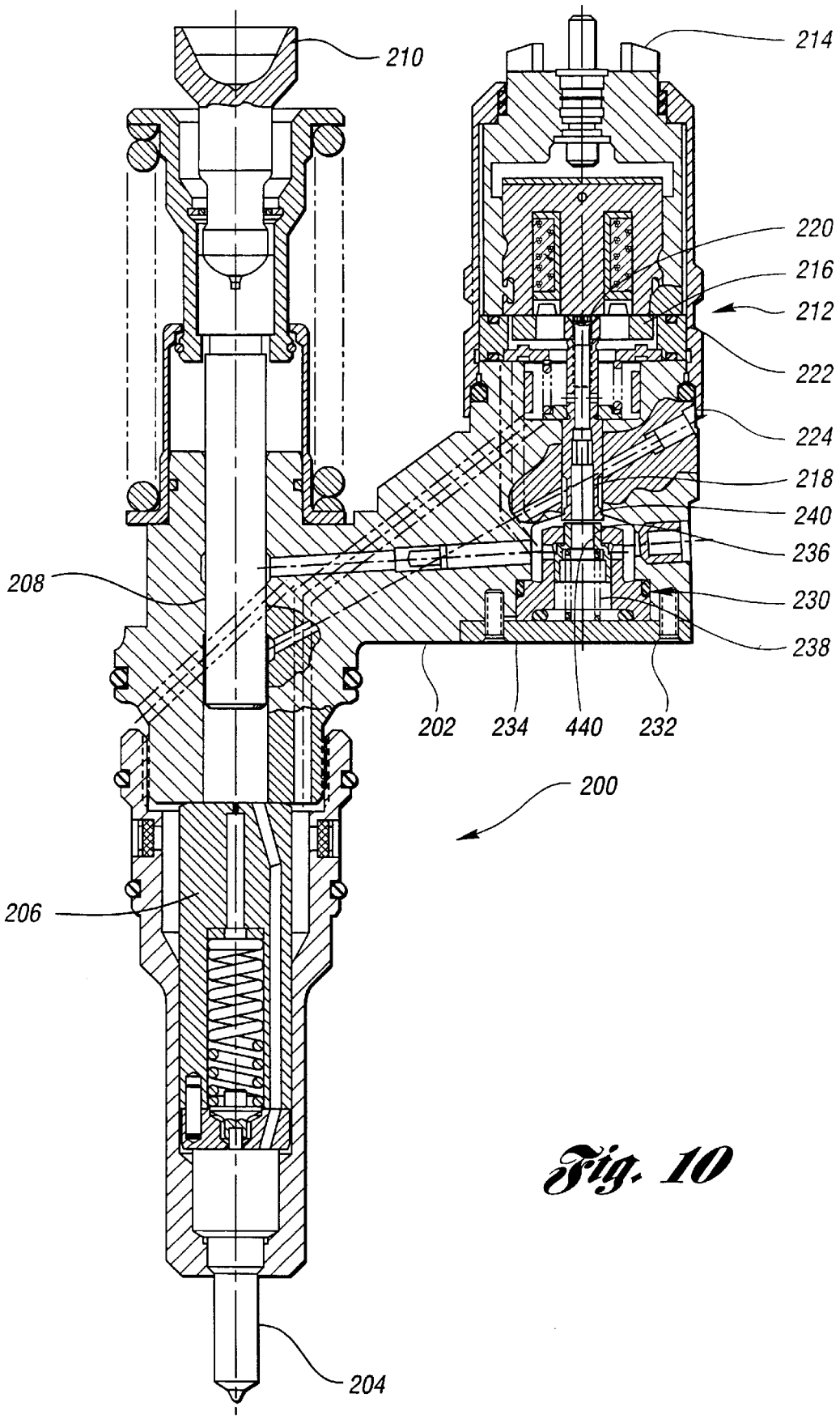
FIG. 10 is a side elevation, in section, of an injector for a fuel injection system made in accordance with the present invention.

With reference to FIG. 10, an injector 200 made in accordance with the present invention is illustrated. Injector 200 has an injector body 202 and a nozzle assembly 204. A spring cage assembly 206 is located adjacent to nozzle assembly 204. A plunger 208 is reciprocatably driven within body 202 by a push rod 210. A stator 214 includes an actuator, such a solenoid, for controlling an electronically controlled valve assembly 212. An armature 216 is secured to a valve body 218 by an armature screw 220. Armature 216 is encircled by a stator spacer 222. Valve body 218 is biased toward a deactuated position, which is the open position, by a control valve spring 224. Upon actuation, armature 216 is pulled toward stator 214 resulting in valve body 218 moving against the spring 224 into the actuated position which is the closed position.

Injector 200 operates in a known manner, as shown, for example, in U.S. Pat. No. 4,618,095, assigned to the assignee of the present invention, and hereby incorporated by reference in its entirety. As depicted, injector 200 employs a valve stop assembly 230 held in place by a stop plate 232. Valve stop assembly 230 includes a main body 234 and a stop member 236. Stop member 236 is biased by valve stop assembly spring 238. Valve stop assembly spring 238 cooperates with control valve spring 224 to produce the first and second spring forces required to establish the force step at a rate shape position (or other intermediate position). In accordance with the present invention, valve body 218 is provided with a step 240. Step 240 on valve body 218 is employed in substantially the same way on unit injector 200 as on the pumps shown in the other figures.

With reference again to FIGS. 2 and 3, generally fuel flows through passageway 26 in pump body 12 toward outlet port 20 in accordance with control valve 46 being opened and closed in a fixed sequence allowing the desired fuel pressure to be developed while closed. Passageway 26 is always open to the pumping chamber, but fuel flow to the nozzle is precluded, as described, and optionally with the assist of a pressure relief valve (not shown) within the high pressure line, pursuant to conventional practice.

More specifically, the opening and closing of control valve 46 in a fixed sequence to allow the desired fuel pressure to be developed while closed will be more specifically described. Fuel is received from a fuel supply by first annulus 150 and supplied to fuel inlet 18. Fuel inlet 18 routes fuel to pumping chamber 16. The cam shaft (not shown) drives cam follower assembly 100. Plunger 30 is moved from its extended position to its compressed position, and fuel is pressurized within pumping chamber 16 when control valve 46 is held closed.

In particular, control valve 46 is held closed to build up initial pressure in pumping chamber 16. Thereafter, in accordance with a preferred embodiment of the present invention, valve body 48 is moved to the rate shaping position to allow a controlled pressure relief path. After rate shaping, valve body 48 is pulled to the fully closed position to complete the fuel injection cycle.

It is to be appreciated that rate shaping techniques of the present invention may be employed for single injection operations and for split injection operations wherein a pilot injection is followed by a main injection. During testing, the inventor has found that injection pressure significantly and desirably decreases when rate shaping at the control valve is performed. During initial injection, this will allow high pumping rates without emissions penalties for improved efficiency Of course, it is to be appreciated that embodiments of the present invention may be employed for control of other hydraulic events other than rate shaping. That is, although embodiments of the present invention are particularly suitable for rate shaping, the step on the valve body may be configured to control, for example, hydraulic behavior at the end of injection, or hydraulic behavior at any other time that throttling is desired.

While the best mode for carrying out the invention has been described in detail, those familiar with the art to which this invention relates will recognize various alternative designs and embodiments for practicing the invention as defined by the following claims.

What is claimed is:

1. A pump for a fuel injection system, the pump comprising:

a pump body having a pumping chamber, a fuel inlet for supplying fuel to the pumping chamber, an outlet port, and a valve chamber between the pumping chamber and the outlet port, the valve chamber defining a valve seat and having an axial guiding portion with a central axis;

a plunger disposed in the pumping chamber;

a valve body disposed in the valve chamber for controlling fuel, the valve body having a valve stem defining a seating surface, the valve stem having a step adjacent to the seating surface, the step extending a limited distance away from the seating surface, the valve body further having a valve guide that is received in the valve chamber guiding portion, and the valve body being axially moveable with respect to the guiding portion over a stroke range including a closed position in which the seating surface engages the valve seat, an intermediate position in which the seating surface is spaced from the valve seat and the step is aligned with the valve seat to provide limited pressure relief, and an open position in which the seating surface and the step are spaced from the valve seat to provide full pressure relief;

a valve spring arrangement biasing the valve body toward the open position;

an armature at the valve body; and a stator near the armature and including an actuator operative to urge the valve body toward the closed position against the bias of the valve spring.

2. The pump of claim 1 wherein the valve body has a generally circular cross-section, the valve guide has a guide diameter, the step has a step diameter, and the step diameter is less than the guide diameter.

3. The pump of claim 1 wherein the step has a cross-section that is sized based on a desired intermediate pressure.

4. The pump of 1 wherein the step has an axial length that is sized based on a desired hydraulic performance at the end of an injection event.

5. The pump of claim 1 wherein the step is configured primarily for injection rate shaping at the beginning of an injection event, and the step has a cross-section that is sized based on a desired rate shaping pressure.

6. The pump of claim 1 wherein the stroke range is at least about 0.1 millimeters.

7. The pump of claim 1 wherein a distance between the closed position and the intermediate position is at most about 0.03 millimeters.

8. The pump of claim 1 wherein the step has an axial length that is about two times a distance between the closed position and the intermediate position.

9. The pump of claim 8 wherein the step axial length is about 0.05 millimeters.

10. The pump of claim 1 wherein the valve body has a generally circular cross-section, the valve guide has a guide diameter of about 7.00 millimeters, and the step has a step diameter of about 6.99 millimeters.

11. The pump of claim 1 wherein the valve spring arrangement comprises:

a primary spring biasing the valve body toward the open position over substantially the entire stroke range; and a secondary spring biasing the valve body toward the closed position over a limited portion of the stroke range between the intermediate position and the open position.

12. A fuel injector comprising:

a injector body having a pumping chamber and a valve chamber defining a valve seat and having an axial guiding portion with a central axis;

a plunger disposed in the pumping chamber;

a valve body disposed in the valve chamber for controlling fuel, the valve body having a valve stem defining a seating surface, the valve stem having a step adjacent to the seating surface, the step extending a limited distance away from the seating surface, the valve body further having a valve guide that is received in the valve chamber guiding portion, and the valve body being axially moveable with respect to the guiding portion over a stroke range including a closed position in which the seating surface engages the valve seat, an intermediate position in which the seating surface is spaced from the valve seat and the step is aligned with the valve seat to provide limited pressure relief, and an open position in which the seating surface and the step are spaced from the valve seat to provide full pressure relief;

a valve spring arrangement biasing the valve body toward the open position;

an armature at the valve body; and a stator near the armature and including an actuator operative to urge the valve body toward the closed position against the bias of the valve spring.

13. The injector of claim 12 wherein the valve body has a generally circular cross-section, the valve guide has a guide diameter, the step has a step diameter, and the step diameter is less than the guide diameter.

14. The injector of claim 12 wherein the step has a cross-section that is sized based on a desired intermediate pressure.

15. The injector of claim 12 wherein the step has an axial length that is sized based on a desired hydraulic performance at the end of an injection event.

16. The injector of claim 12 wherein the step is configured primarily for injection rate shaping at the beginning of an injection event, and the step has a cross-section that is sized based on a desired rate shaping pressure.

17. The injector of claim 12 wherein the stroke range is at least about 0.1 millimeters.

18. The injector of claim 12 wherein a distance between the closed position and the intermediate position is at most about 0.03 millimeters.

19. The injector of claim 12 wherein the step has an axial length that is about two times a distance between the closed position and the intermediate position.

20. The injector of claim 19 wherein the step axial length is about 0.05 millimeters.

21. The injector of claim 12 wherein the valve body has a generally circular cross-section, the valve guide has a guide diameter of about 7.00 millimeters, and the step has a step diameter of about 6.99 millimeters.

22. The injector of claim 12 wherein the valve spring arrangement comprises:

a primary spring biasing the valve body toward the open position over substantially the entire stroke range; and a secondary spring biasing the valve body toward the closed position over a limited portion of the stroke range between the intermediate position and the open position.

23. A control valve for use in a fuel injection system, the control valve comprising:

a housing defining a valve chamber, the valve chamber defining a valve seat and further defining an axial guiding portion with a central axis; and a valve body disposed in the valve chamber for controlling fuel, the valve body having a valve stem defining a seating surface, the valve body further having a valve guide that is received in the valve chamber guiding portion, and the valve body being axially moveable with respect to the guiding portion over a stroke range between a closed position in which the seating surface engages the valve seat and an open position in which the seating surface is spaced from the valve seat to provide pressure relief, the valve stem having a step immediately adjacent to the seating surface, the step extending a limited distance away from the seating surface to provide limited pressure relief when the valve body is at an intermediate position that is between the open and closed positions.

24. An engine comprising:

an engine block having at least one cylinder;

at least one fuel injector positioned to feed fuel to the at least one cylinder, the fuel injector being in communication with a fuel supply; and a control valve located between the at least one cylinder and the fuel supply, the control valve including a housing defining a valve chamber, the valve chamber defining a valve seat and further defining an axial guiding portion with a central axis, and the control valve further including a valve body disposed in the valve chamber for controlling fuel, the valve body having a valve stem defining a seating surface, the valve stem having a step adjacent to the seating surface, the step extending a limited distance away from the seating surface, the valve body further having a valve guide that is received in the valve chamber guiding portion, and the valve body being axially moveable with respect to the guiding portion over a stroke range including a closed position in which the seating surface engages the valve seat, an intermediate position in which the seating surface is spaced from the valve seat and the step is aligned with the valve seat to provide limited pressure relief, and an open position in which the seating surface and the step are spaced from the valve seat to provide full pressure relief.

* * * * *